US006708968B2

(12) United States Patent
Honegger

(10) Patent No.: US 6,708,968 B2
(45) Date of Patent: Mar. 23, 2004

(54) DEVICE FOR GATHERING FLAT ARTICLES INTO STACKS AND FOR FURTHER PROCESSING THE STACKS

(75) Inventor: Werner Honegger, Bäch (CH)

(73) Assignee: Ferag AG, Hinwil (CH)

( * ) Notice: Subject to any disclaimer, the term of this patent is extended or adjusted under 35 U.S.C. 154(b) by 21 days.

(21) Appl. No.: 10/126,813

(22) Filed: Apr. 19, 2002

(65) Prior Publication Data

US 2002/0159874 A1 Oct. 31, 2002

(30) Foreign Application Priority Data

Apr. 26, 2001 (CH) ..... 2001 0764/01

(51) Int. Cl.[7] ..... B42C 19/08

(52) U.S. Cl. ..... 270/58.12; 270/58.2; 270/522; 198/803.7; 198/803.14; 412/33

(58) Field of Search ..... 270/52.2, 52.19, 270/58.12, 58.13, 58.2, 58.21, 58.16; 198/803.7, 803.14, 418.6; 412/33

(56) References Cited

U.S. PATENT DOCUMENTS

| | | | | |
|---|---|---|---|---|
| 4,479,643 A | | 10/1984 | Seidel | |
| 5,269,504 A | | 12/1993 | Backman | |
| 5,662,319 A | | 9/1997 | Honegger | |
| 5,788,446 A | * | 8/1998 | Stolz | 412/33 |
| 5,921,538 A | * | 7/1999 | Schlough | 270/52.18 |
| 6,447,229 B1 | * | 9/2002 | Schlough | 270/58.07 |

FOREIGN PATENT DOCUMENTS

| | | |
|---|---|---|
| EP | 0 247 315 A1 | 12/1987 |
| EP | 0 712 736 A2 | 5/1996 |
| EP | 0 712 736 B1 | 5/1996 |
| EP | 0 908 408 A2 | 4/1999 |

* cited by examiner

*Primary Examiner*—Christopher P. Ellis
*Assistant Examiner*—Mark A. Deuble
(74) *Attorney, Agent, or Firm*—Rankin, Hill, Porter & Clark LLP

(57) ABSTRACT

Flat articles are gathered on stack supports (2) being conveyed past feed points substantially continuously and one after the other. After the gathering operation, bottom edge zones (13) of the gathered articles are exposed for a further processing operation. The corresponding device includes continuously conveyed stack supports (2) each with an inclined supporting surface (3) and a foot element (4) located in the bottom area of the supporting surface (3). The foot elements are actively connected with the supporting surfaces such that they are capable of being pressed against the supporting surface and of being spaced from the supporting surface. In an exposure zone downstream of the gathering zone (1), stack support structure, which are conveyed in synchronism with the stack supports (2) and substantially in the same direction, and a control device are provided. At the entrance to the exposure zone (1), the stack support structure is arranged so as to be positioned immediately underneath the stack supports and such that, further downstream, the stack support structure moves away from the stack supports (2) in a downwards direction. The control device acts on the foot elements (4) of stack supports (2) conveyed through the exposure zone such that the foot elements are spaced from the supporting surfaces (3) at the entrance to the exposure zone for letting the stacks slide down onto the stack support device, and such that the stacks having slid down onto the stack support device (10) are clamped between the foot element and the supporting surface. The exposed edge zones (13) of the gathered articles can then be processed in a simple way and/or can be taken hold of by further conveying device.

15 Claims, 6 Drawing Sheets

Fig.3
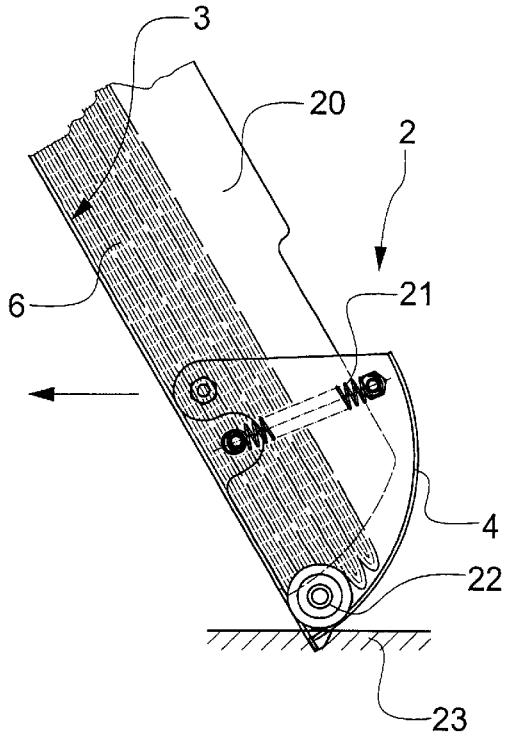
Fig.4
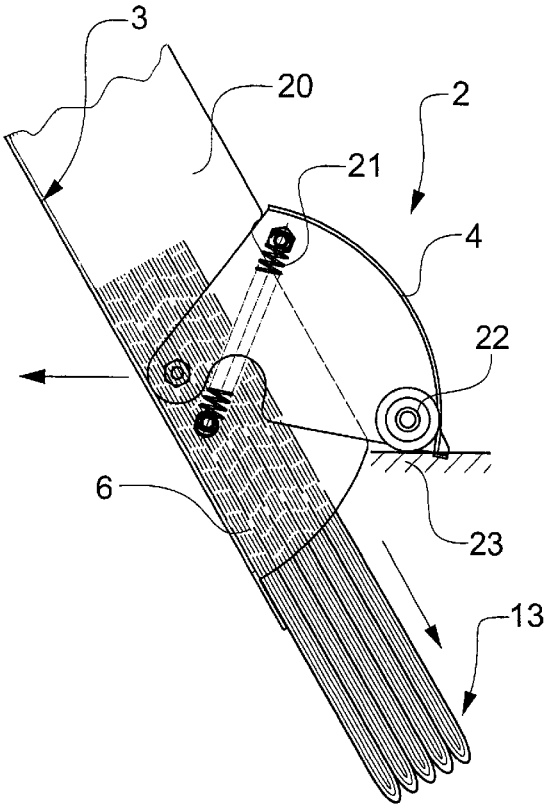
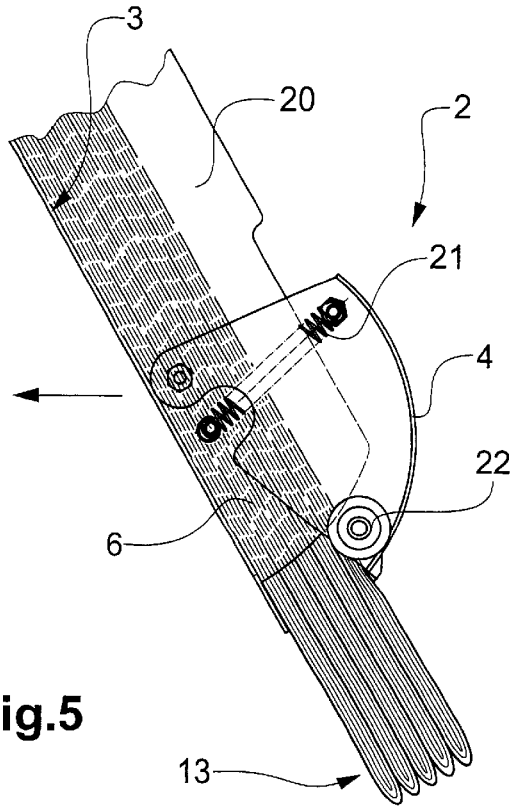
Fig.5

DEVICE FOR GATHERING FLAT ARTICLES INTO STACKS AND FOR FURTHER PROCESSING THE STACKS

BACKGROUND OF THE INVENTION

1. Field of the Invention

The present invention is related to the field of materials handling technology and concerns a device for continuously gathering flat articles in a serial production of article stacks and for further processing the produced stacks.

2. Description of Related Art

In the printing and book-binding industry it is known to produce stacks of sheets, stacks of folded sheets, stacks of signatures or stacks of other printed products by providing a row of feed points, by conveying stacks being produced along the row of feed points one after the other in a substantially continuous manner and by adding one printed product to each stack at every feed point. The device for conveying the stacks being produced comprises, for example, a plurality of essentially V-shaped pockets arranged one behind the other. These pockets have upwardly-directed openings that extend substantially transverse to the conveying direction and the printed products are introduced into the pockets with one edge leading. A stack already present in the pocket is leaning against one of the walls of the pocket and, if so required, is pressed against this wall with suitable means, so that the product to be added can be introduced securely and precisely. For the same purpose, it is also possible to provide L-shaped stack supports arranged one behind the other, each respectively with a supporting surface and a foot element, wherein the supporting surfaces extend transverse to the conveying direction and advantageously are inclined relative to vertical. The supplied printed products are advantageously laid onto these supporting surfaces being guided at their leading edge, as is described, for example, in the Swiss patent application No. 2525/00 of the same applicant.

It is also known to remove the stacks of flat articles gathered in the manner briefly outlined above from the V-shaped pockets by opening the bottom of the pockets and letting the stacks fall out of the pockets driven by gravity.

In the publication EP-0908408 it is proposed to open such gathering pockets after completion of the stacks during continuous conveyance at their bottom, so that gravity relocates the stacks into lower pockets arranged to adjoin the gathering pockets. The walls of the lower pockets are movable such that the dropped stack is capable of being clamped between these walls, and so that when opening this pocket, the bottom side of the stack or all bottom edges of the flat articles gathered in the stack become freely accessible while the stack is being gripped in the lower pocket. For being bound, the exposed side of the stacks are then, for example, roughened, trimmed and/or treated with adhesive. Following this treatment, the stack is released by the pocket walls and dropped in a controlled manner.

Gathering of printed products in pockets being substantially continuously conveyed, is described also in the publication EP-0712736. Each finished stack is then clamped and gripped by the walls of the pocket such that the pocket can be opened at the bottom and the position of the stack remains unchanged relative to the pocket walls. The pocket comprises a U-shaped base part, which, for opening the pocket, is moved away downwards. The article edges on the bottom side of the stack being exposed in this manner are further treated for binding the stack, for which purpose the stack together with the clamping pocket walls is inserted into clamping tongues.

SUMMARY OF THE INVENTION

An object of the present invention is to create a device for continuously gathering flat articles into stacks and for further processing the stacks, with which device specific edges of the stacked, flat articles are aligned to one another during stacking and are made accessible for further processing on the finished stack and with which device the stacks with the exposed edge zones are conveyed to a processing operation. The device according to the invention differs from known devices with the same purpose, particularly by being more universally utilisable and simpler and by being significantly more easily adaptable to different requirements with respect to the exposure of the edge zones of the stacked, flat articles.

The device in accordance with the invention comprises, in a per se known manner, a plurality of stack supports that are substantially continuously conveyed one after the other in a conveying direction. These stack supports are essentially continuously conveyed, first, for producing the stacks by gathering articles, along a row of feed points, then through an exposure zone and from there to further processing.

The stack supports have supporting surfaces substantially aligned transverse to the conveying direction and foot elements arranged at the bottom end of each supporting surface. The foot element is actively connected to the supporting surface such that it is capable of being pressed against the supporting surface with a pressing force and such that by the action of suitable control means or by stopping the pressing force it can be spaced from the supporting surface and from this spaced position is able to be released again into the pressing position.

During the gathering operation, the flat articles are laid against the advantageously inclined supporting surfaces and their bottom edges are aligned to one another by the foot element, which in this phase is pressed against the supporting surface. The supporting surface and foot element together carry the stack in a defined position during production and after completion.

Downstream the last feed point there is an exposure zone, through which the stack supports are conveyed in substantially the same manner as along the row of feed points. Also conveyed through the exposure zone are stack support means and this in synchronism with the stack supports and aligned to them, wherein the conveying path of the stack supports and the conveying path of the stack support means are designed such that, at the entrance to the exposure zone, the stack support means are arranged immediately underneath the stack supports and such that, during conveyance through the exposure zone, they move more and more away downwards from the stack supports.

Furthermore, means for controlling the foot elements are provided in the exposure zone. A first such control means spaces the foot elements from the supporting surfaces at the point in which the stack support means are moving immediately underneath the stack supports, i.e. at the entrance of the exposure zone, such that the stacks lying against the supporting surfaces are released downwards and, still lying against the supporting surfaces, slide down onto the stack support means. The stacks are further conveyed lying against the supporting surfaces and supported by the stack support means until, as a result of the divergence of the conveying paths of stack supports and stack support means, they have slid off the stack supporting surface to such an extent that the bottom edges of the stacked flat articles protrude from the bottom edges of the supporting surfaces by a predefined value. At this point, a second control means releases the foot elements from their position spaced from the supporting surface to their pressing position. Through their sliding the stacks are now positioned between the supporting surface and the foot element, i.e. the foot element when released into the pressing position is not anymore pressed directly against the supporting surface but against the stack, so that the stack is pressed between foot element and supporting surface and, therefore, is fixed in its position relative to the supporting surface. Further sliding of the stack is not possible anymore.

With the stack clamped between the supporting surface and the foot element, the stack supports are conveyed onwards, wherein their spatial orientation can now be changed, for example, by swivelling the stack supports relative to the conveying path or by changing the direction of the conveying path. Through such changes of the spatial orientation of the stack supports and the stacks of flat articles clamped in them, the aligned edge zones protruding beyond the supporting surfaces, which were originally oriented downwards, can be oriented to suit a following processing operation.

For releasing stacked, flat articles possibly processed in the area of the exposed edge zones, from their clamped position in the stack supports, the part of the stack protruding between the supporting surface and the foot element can simply be taken hold of with suitable means and then the foot element can be brought back into its position spaced from the supporting surface.

Instead of L-shaped stack supports as described above, the device according to the invention may also comprise V-shaped gathering pockets extending substantially transverse to the conveying direction and comprising two pocket walls located opposite one another in the direction of conveyance. One of the pocket walls represents the supporting surface and the foot element closes off the distance between the pocket walls at the pocket bottom.

It goes without saying that using the device in accordance with the invention, it is not only possible to produce and further process stacks comprising a plurality of flat articles but it is also possible to clamp and further process individual articles, i.e. "stacks" comprising only one flat article.

BRIEF DESCRIPTION OF THE DRAWINGS

These and further features of the invention will be apparent with reference to the following description and drawings, wherein:

FIGS. 3 to 5 illustrate in detail the operation of the foot element on the embodiment according to FIGS. 1 and 2;

DETAILED DESCRIPTION OF THE PREFERRED EMBODIMENTS

Figure 1:
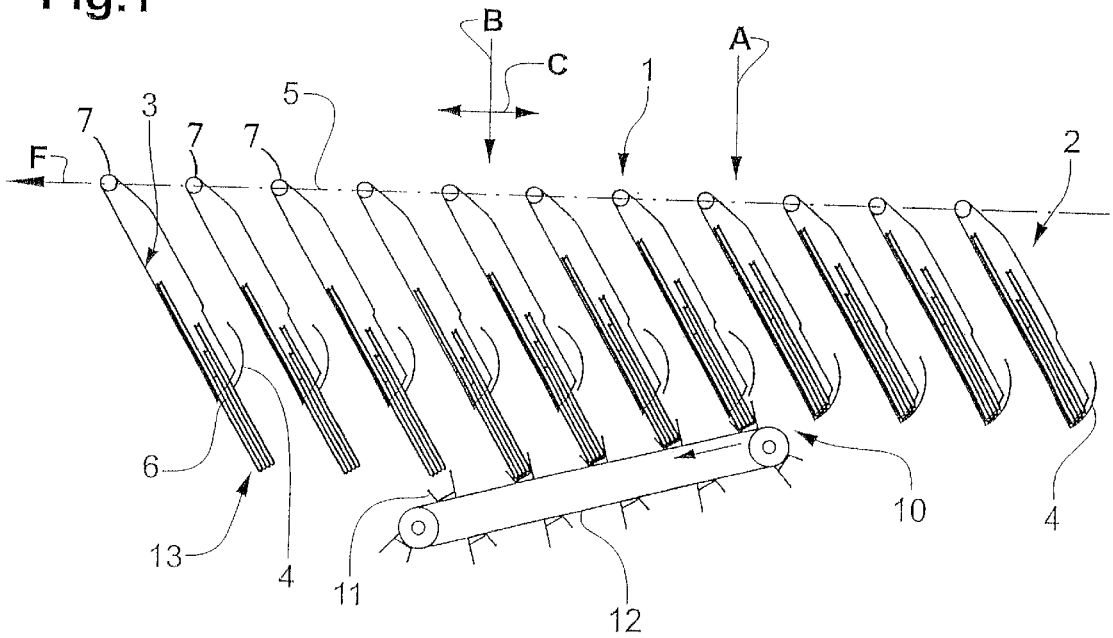
FIGS. 1 and 2 show, in two operational modes, the exposure zone of a first embodiment of the device in accordance with the invention.

FIG. 1 illustrates a first embodiment of the device according to the invention in the exposure zone 1, through which stack supports 2 move substantially continuously (conveying direction F) and with essentially the same spatial orientation, in which they are conveyed along the row of feed points. Each of the stack supports 2 includes a supporting surface 3 and a foot element 4. The stack supports 2 are coupled to a conveying organ (dot-dash line 5) by swiveling means 7 at equal distances between one another, as illustrated. They may also, however, be movable in the conveying direction F substantially independent of one another. The supporting surfaces 3 of the stack supports 2 extend substantially transverse to the conveying direction F (perpendicular to the paper plane of FIG. 1) and are arranged inclined in the conveying direction, such that, for example, their bottom edges trail the upper edges.

Each one of the stack supports 2 being conveyed into the exposure zone 1 carries a stack 6, wherein the flat articles of the stack 6 were deposited in an as such known manner on the stack supports 2 during conveyance along a row of feed points arranged upstream of the exposure zone 1 illustrated in FIG. 1.

Stack support means 10 are arranged to move through the exposure zone underneath the stack supports 2, in synchronism with the stack supports 2 and aligned with the stack supports 2 such that, at the entrance to the exposure zone 1, the stack support means 10 are positioned immediately underneath the bottom edges of the supporting surfaces 3 and such that, during their conveyance through the exposure zone 1, the stack support means 10 moves away from the stack supports 2 at an acute angle. The stack support means 10, for example, comprises individual stack support bases 11 coupled to a conveying organ 12 with a closed-in-itself circulation track.

At the point designated with A and approximately corresponding to the point at which the stack base supports 11 are situated closest to the supporting surfaces 3, a first control means (not illustrated) is effective to bring the foot elements 4 of stack supports 2 being conveyed therepast into a position spaced from the supporting surface 3. As a result, the stack 6 lying against the supporting surface 3 slides down onto the stack support base 11.

During onward conveyance and due to the divergence of the conveying paths of the stack support 2 and the stack support base 11, the stack 6 slides down further and more and more protrudes beyond the supporting surface 3.

At the point designated with B and situated downstream of point A, a second control means (not shown) is arranged to release the foot elements 4 of stack supports 2 into their pressing position from their position spaced from the supporting surface 3, in order to press the slid down stack 6 against the supporting surface 3 and to thus fix it in a position protruding beyond the supporting surface 3.

In a zone downstream of point B, the stack support bases 11 are moved away from the stack supports 2, as a result of which the bottom edge zones 13 of the stacked, flat articles, which protrude beyond the supporting surface 3 and the foot element 4, become freely accessible for further processing of the stacks.

From FIG. 1 it is clearly evident, that the stack supports 2 are very simple device components that are capable of being conveyed along the conveying path following one another very closely. It is also evident, that the stack supports 2, when holding a stack 6 clamped between supporting surface 3 and foot element 4 can be brought into various spatial orientations, for example by being swiveled by the swiveling means 7 parallel to the conveying path F and/or by changing the direction of the conveying path. In this way, the exposed, originally bottom edge zones 13 of the stacked, flat articles can be made optimally accessible for a processing operation or for transfer to a further conveying device.

From FIG. 1 it is also evident that the device according to the invention is very easily adaptable for different handling operations of different stacks. Within the broadest limits it is of no importance how large (also how differently large) and how numerous the stacked, flat articles are. As long as they each have a substantially straight edge zone and as long as this edge zone of all articles to be stacked are to be aligned to one another, the device can be used without any modifications. For adjusting the length, by which the bottom edge zones 13 in their exposed condition are to protrude beyond the supporting surface 3, advantageously the point B or the second control means, respectively, is moved along the conveying path F (arrows C). On the other hand, it is also possible to adjust the angle between the conveying path F of the stack supports 2 and the conveying path of the stack support bases 11.

The stack support bases 11 illustrated in FIG. 1 extend, parallel to the supporting surfaces 3 and the foot elements 4, substantially transverse to the conveying direction F and comprise a floor surface, which advantageously is aligned perpendicular to the supporting surfaces 6. With stack supports 11 of this kind, the stacks 6 obtain a rectangular shape. In cases in which such rectangularity is not relevant, it is also possible for a very simple conveyor belt to take over the function of the individual stack support bases illustrated in FIG. 1.

Figure 2:
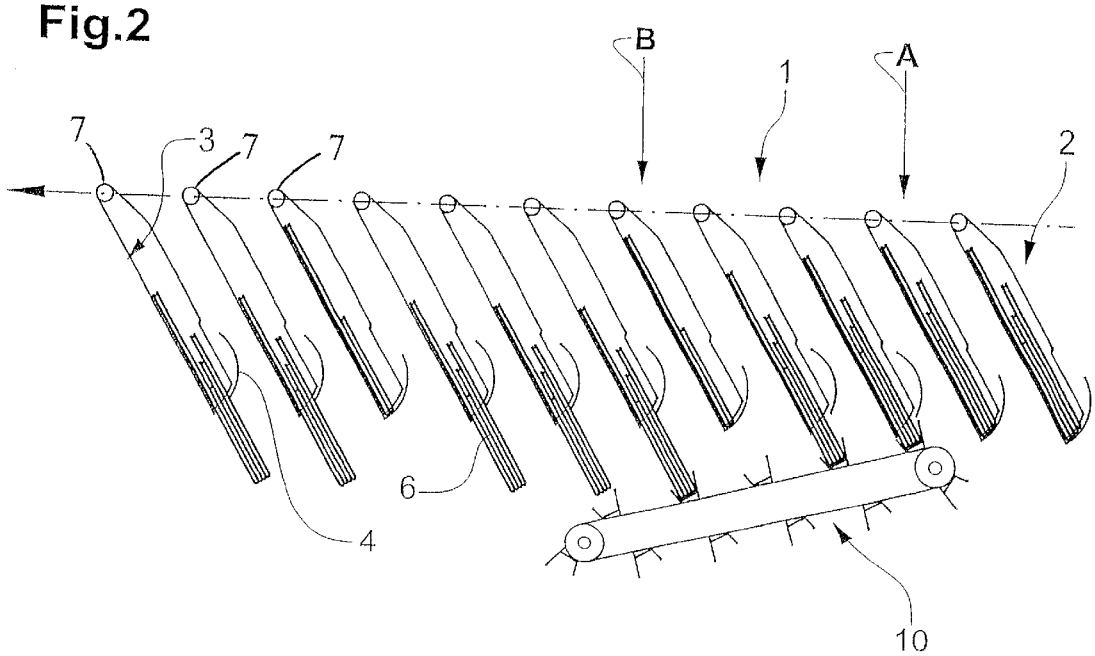

FIG. 2 illustrates essentially the same device as FIG. 1. While the device in accordance with FIG. 1 is operated in a mode in which the foot elements 4 of all stack supports 2 being conveyed past point A are actuated, according to FIG. 2, only selected ones of the stack supports 2 are actuated. For example, only stack supports that contain an error-free stack 6 are actuated. Stack supports 2 that are not actuated are conveyed through the exposure zone 1 in an unchanged condition.

For controlling the operating mode according to FIG. 1, the control means are, for example, stationary cams co-operating with guide rollers arranged on the foot elements 4 of the stack supports 2. For controlling the operating mode according to FIG. 2, active control means have to be provided to selectively actuate control elements acting on the foot elements 4 of the selected stack supports.

FIGS. 3 to 5 show in more detail the operation mode of an exemplary embodiment of a stack support 2 in the device illustrated in FIGS. 1 and 2. Illustrated are the bottom zones of a stack support 2 in a configuration suitable for the gathering operation (FIG. 3), suitable for the exposure of the bottom edge zones 13 of the stacked, flat articles or for releasing a stack (FIG. 4) and suitable for further processing the stack 6 or the exposed edge zones 13 of the stack respectively (FIG. 5).

In each of FIGS. 3–5, the bottom part of the supporting surface 3 is limited on both sides by side pieces 20 (only one shown), and a stack 6 is shown lying against the supporting surface 3. The foot element 4 is fixed to the side pieces 20 so as to be capable of swivelling and is driven against the supporting surface 3 by a tension spring 21 pre-tensioned between the side piece 20 and the foot element 4. The foot element 4 further comprises a guide roller 22, which, when rolling on a corresponding cam surface 23, brings the foot element 4, against the tensile force of the tension spring 21, into a position more or less spaced from the supporting surface 3 and holds it in such a position. The cam surface 23 is necessary in zones of the conveying path (FIG. 4) in which the foot elements 4 have to be held in a position spaced from the supporting surface 3. The cam surface 23 can be absent in zones of the conveying path (FIGS. 3 and 5) in which the foot element 4 is pressed against the supporting surface 3 or against a stack 6 lying against the supporting surface 3 with the full force of the tension spring.

FIG. 3 depicts the foot element 4 in the gathering configuration, into which it is driven by the force of the tension spring 21, when no stack 6 is positioned between the supporting surface 3 and foot element 4. In this position, the foot element is tightly joined with the supporting surface 3 such that it is capable of supporting flat articles lying against the supporting surface 3.

FIG. 4 illustrates the stack support 2 in the exposure or release configuration, in which it is conveyed through the exposure zone, i.e. through the zone between points A and B depicted in FIGS. 1 and 2, and through a release zone, in which a stack is released from the position clamped between supporting surface 3 and foot element 4. The foot element 4 is spaced from the supporting surface 3 such that the bottom end of the supporting surface 3 is free and flat articles lying against the supporting surface 3 can slide down along it or are able to be removed from between the supporting surface 3 and the foot element 4. During conveyance, the foot element 4 is held in this position by the cam surface 23 and the guide roller is pressed against the cam surface by the spring force of tension spring 21.

FIG. 5 illustrates the stack support 2 in the processing configuration, into which it is brought, when stacks 6 lying against the supporting surface 3 and being supported by the stack support means (not depicted) have slid beyond the supporting surface 3 by a predetermined amount (point B in FIGS. 1 and 2). The foot element 4 is pressed by the tension spring 21 against the stack 6 and is firmly holding the stack.

Instead of the tension spring 21, it is possible to use other means to press the foot element 4 against the supporting surface. This function, for example, may also be taken over by the guide rollers 22 and a corresponding cam surface. For the operating mode illustrated in FIG. 2, cam surfaces are not suitable control means. In this case, active control means selectively unlatching the tension spring 21 have to be provided.

Figure 6:
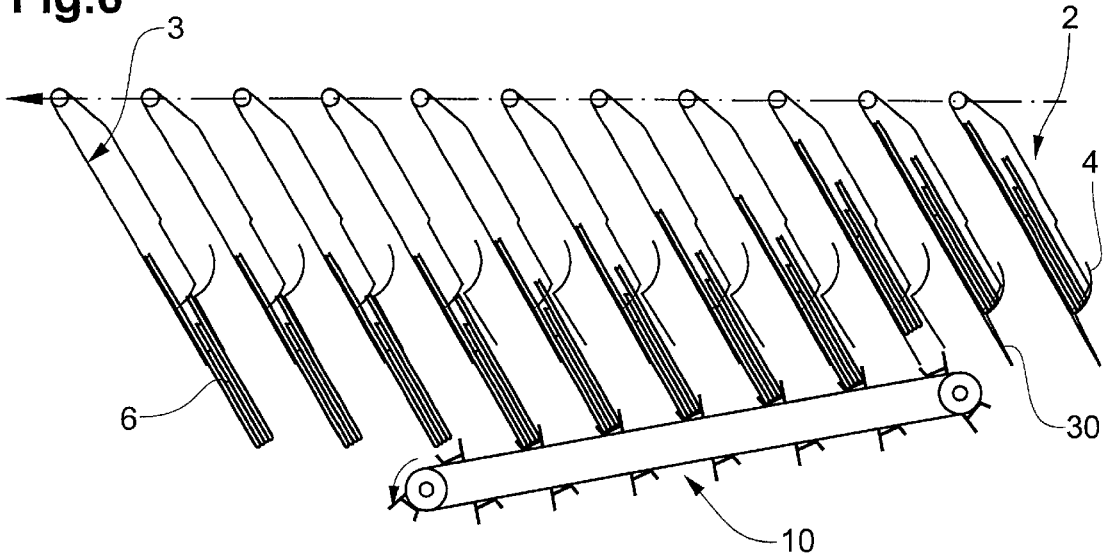
FIGS. 6 and 7 show the exposure zones of two further, exemplary embodiments of the device according to the invention; and, FIGS. 8 to 12 show the embodiment of the device in accordance with the invention as shown in FIGS. 1 and 2 in processing zones in which the stacks are held clamped between the supporting surface and the foot element.
Figure 7:
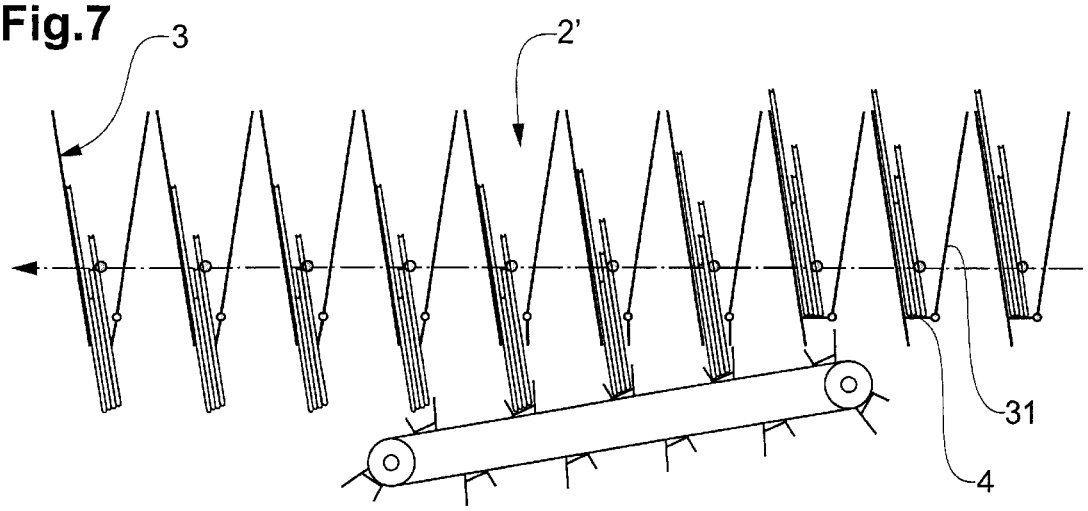

FIGS. 6 and 7 illustrate two further, exemplary embodiments of the device according to the invention.

The stack supports 2 according to FIG. 6 each have an extension 30 on the supporting surface 3 and a foot element 4 running substantially parallel to one another in a downwards direction and forming a sort of flat pliers for holding the stack 6 even better than is possible with the embodiment according to FIGS. 1 and 2.

FIG. 7 very schematically illustrates a further, exemplary embodiment of the device according to the invention, in which the supporting surfaces 3 and foot elements 4 form components of substantially V-shaped gathering pockets 2'. The foot elements 4 are each connected in an articulated manner to a pocket wall 31 situated opposite the supporting surface 3 and are driven into a "closed" position by pressing means (not shown) and into an "open" position by suitable control means.

FIGS. 8 to 12 illustrate the embodiment of the device according to the invention as depicted in FIGS. 1 to 5 in a conveying zone downstream of the exposure zone. In this zone, the stacks 6 are further processed by action on the edge zones 13 of the flat articles. This further processing has to be understood in a very broad meaning of the term. It shall not only include steps modifying these edge zones (for example by binding of a stack of printed products), but may also be a pure handling operation (for example a transfer to a further conveying device) or may be both.

Figure 8:
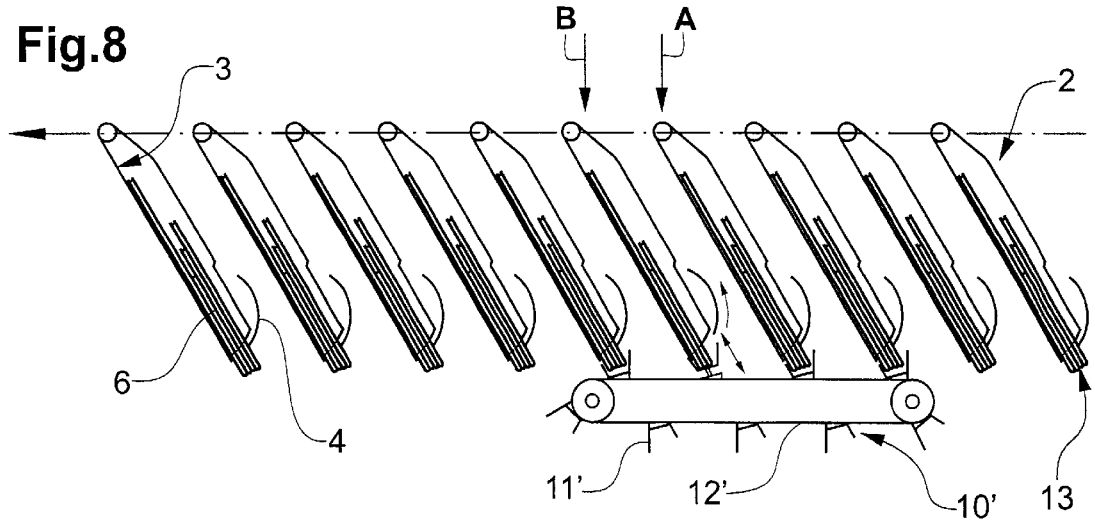

FIG. 8 illustrates a stack handling operation substantially consisting of reversing the exposure of the bottom edge zones 13 possibly after processing these edge zones 13. The stack supports 2 hold stacks 6 pressed between the supporting surfaces 3 and foot elements 4 when conveyed into this zone, in which further stack support means 10' with stack support bases 11' conveyed parallel to the stack supports 2 are provided. These stack support bases 11' are adjustable in their height relative to a conveying organ 12' in such a manner and to such an extent, that they are capable of pushing back stacks 6 along the supporting surface 3. In analogy to the exposure zone, a first control means is provided for driving the foot elements 4 at a point A and, at a point B, a second control means is provided. The first and second control means, as already described in connection with FIG. 1, act on the foot elements 4 of all stack support 2 conveyed past or only on the foot elements 4 of selected ones of the stack supports 2 (as illustrated in FIG. 8).

For a processing operation as illustrated in FIG. 8, it is a prerequisite that the stack support bases 11' and the foot elements 4 are designed such that they are able to mesh with one another. The stack support bases 11' therefore, for example, comprise gaps along their extent transverse to the conveying direction or else are narrower than the stacked articles, and the foot elements 4 consist of at least two foot element components, which are aligned to the named gaps or else are arranged lateral to the stack support bases 11'.

Figure 9:
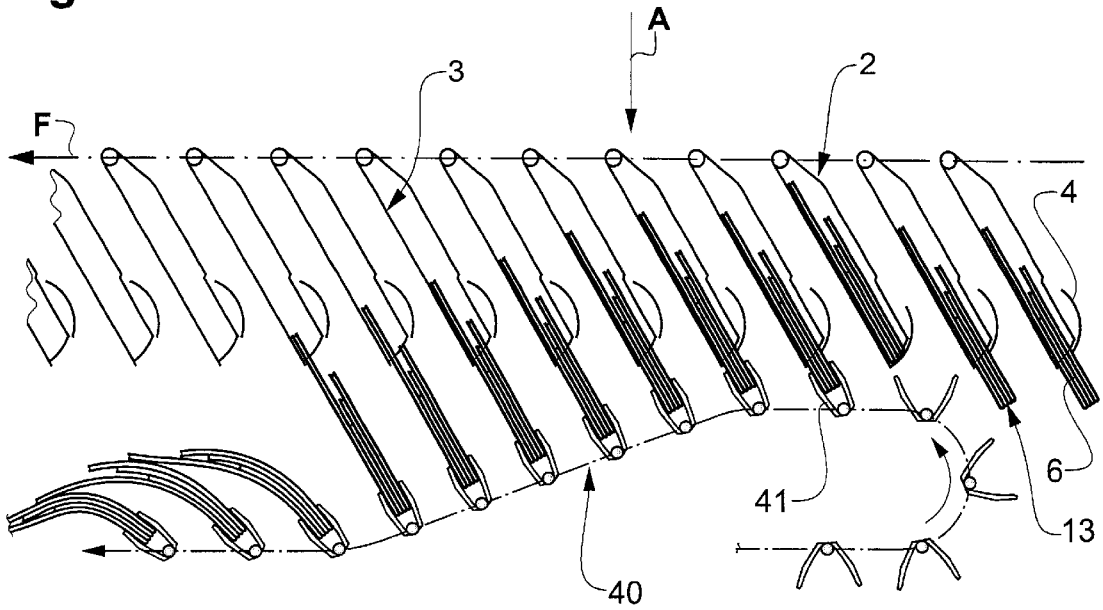
Figure 10:
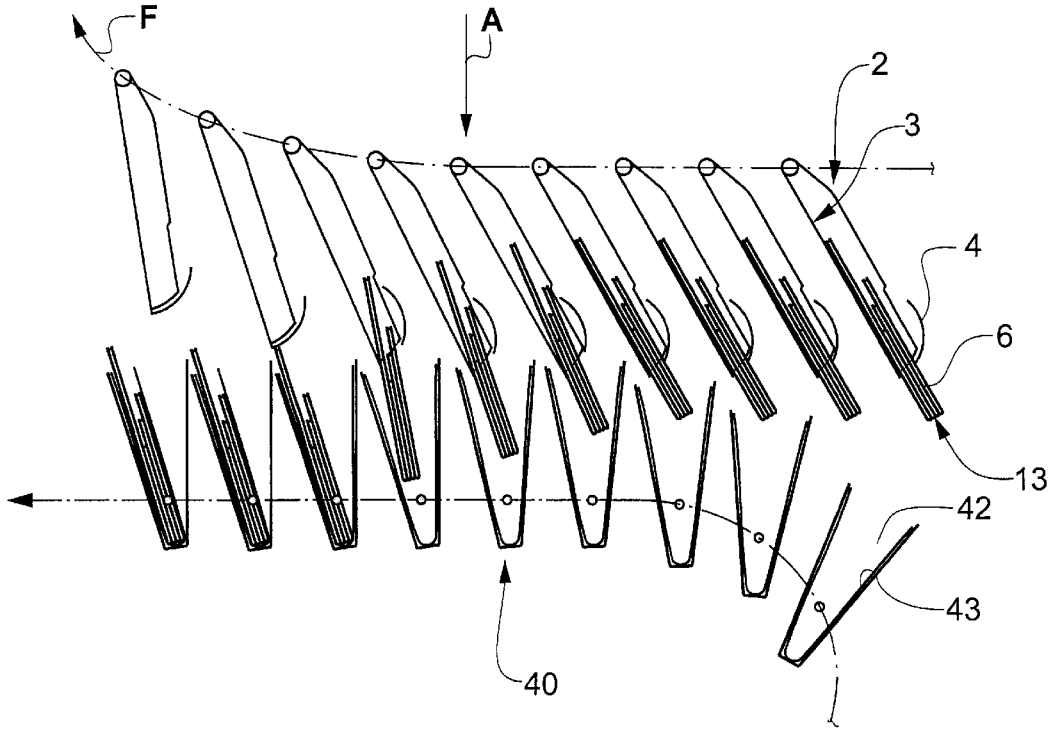
Figure 11:
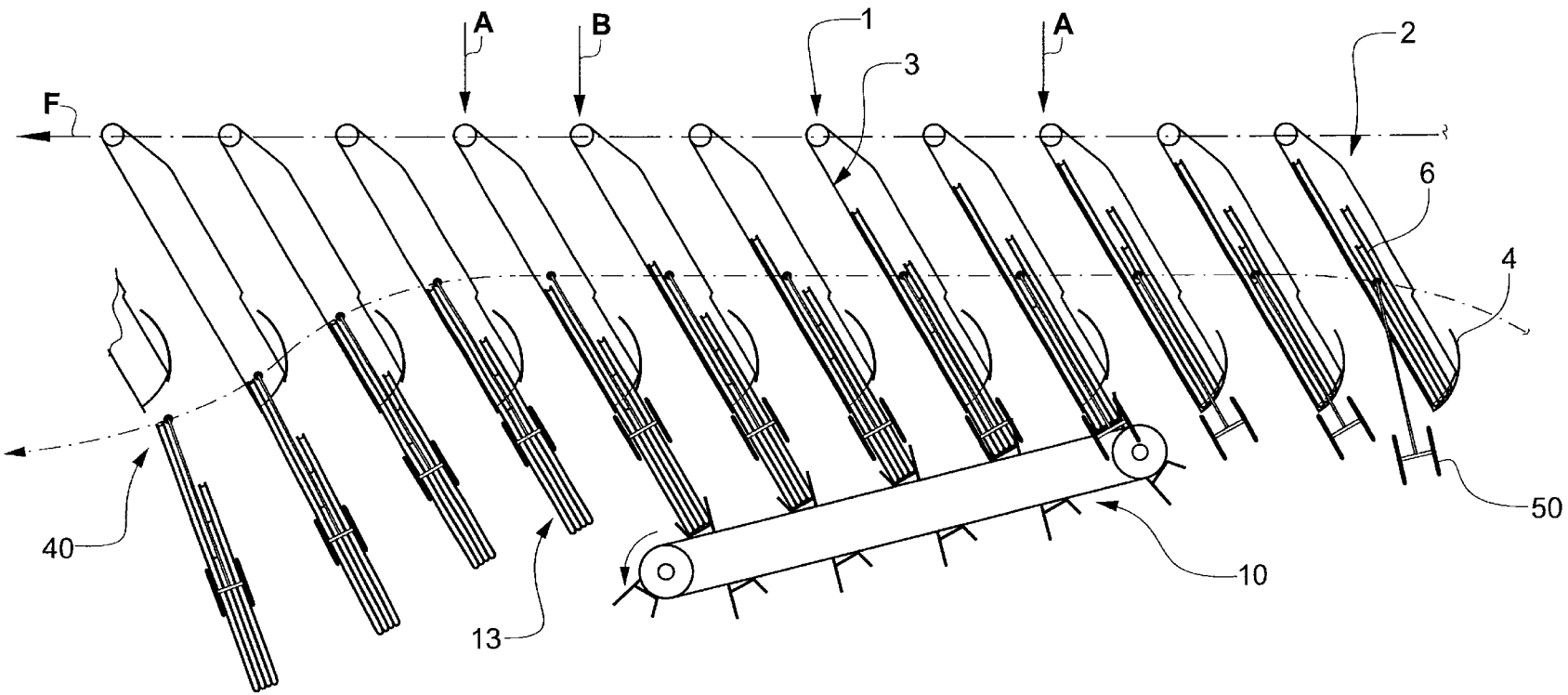

FIGS. 9 to 11 illustrate transfer zones in which stacks held clamped between supporting surfaces 3 and foot elements 4 are transferred to a further conveying means 40. To achieve this, at a point A of the conveying path F a first control means is provided for bringing the foot elements 4 of stack supports 2 conveyed past into the position at a distance from the stack supporting surface 3.

In accordance with FIG. 9, the further conveying means 40 comprises grippers 41 for gripping the exposed edge zone 13 before the stack supports 2 are conveyed past point A. According to FIG. 10, the taking over conveying means 40 comprises pockets 42, in which covering sheets 43 may already be positioned. The exposed edge zones 13 are inserted into these pockets as far as possible before the stack supports 2 pass point A, where the stacks 6 are released by actuation of the foot elements 4 and are left to fall into the pockets. For this case it is particularly advantageous if the stacks 6 protrude beyond the supporting surfaces 3 as far as possible, such that free fall is as short as possible.

According to FIG. 11, the exposure zone 1 and the transfer zone substantially coincide. Already during the exposure of the bottom edge zones 13 in the exposure zone 1 while sliding along the supporting surfaces 3, the stacks 6 are inserted into clamping means 50 of a further conveying means 40 and downstream of the exposure zone they are gripped by the clamping means 50, and then released by the foot elements 4.

Figure 12:
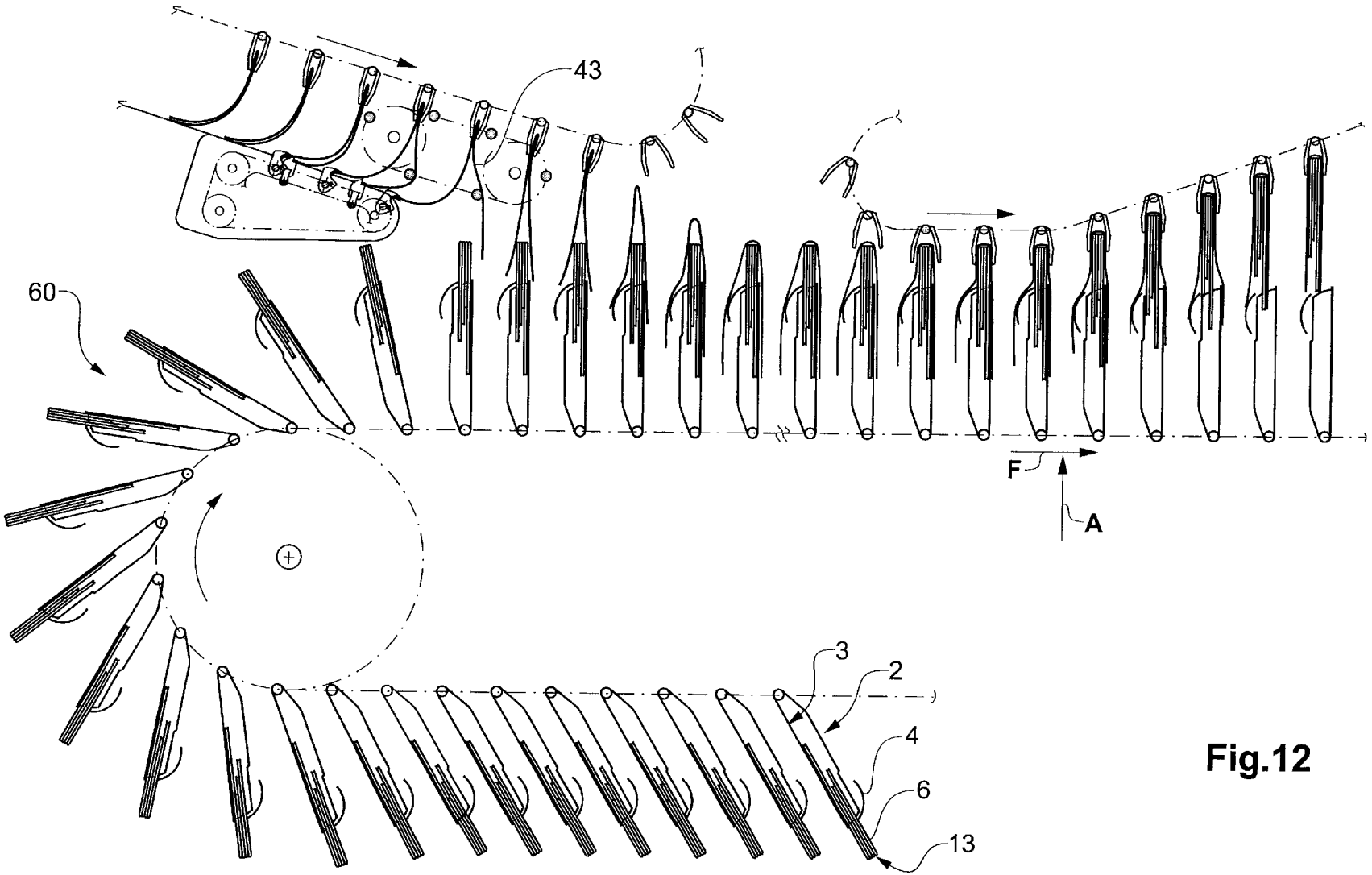

FIG. 12 illustrates further processing of stacks 6 held clamped in stack supports 2, the processing regarding the area of the exposed edge zones 13. The stacks 6, which at least in the exposure zone are downwardly directed, are brought into a vertical position in which the exposed edge zones 13 are oriented upwards by a change 60 of the conveying direction F of the stack supports 2 and a corresponding swivelling of the stack supports 2 relative to the conveying path. With the new stack orientation, the stack supports 2 are conveyed through a processing zone for further processing of the stacks 6 and then through a release zone. In the processing zone, folded covering sheets 43 are opened and laid over the exposed edge zones. In the release zone, the exposed edge zones 13 with covering sheets 43 laid over them are gripped by suitable grippers and are released by the foot elements 4 (point A).

Prior to the placement of the covering sheets 43, the exposed edge zones, if so required, may be roughened or trimmed and treated with adhesive. After placement of the covering sheets 43, they may be correspondingly pressed. It is also conceivable to apply more than one covering sheet 43 and, prior to releasing the stacks 6, to tack the multitude of covering sheets together.

What is claimed is:

1. A device for gathering flat articles into stacks (6) and for further processing the stacks (6), the device comprising:

a plurality of stack supports (2), control means and means for continuously conveying the stack supports (2) one behind the other along a conveying path (F) through a gathering zone, an exposure zone downstream of the gathering zone and a processing zone downstream of the exposure zone, wherein the conveying path (F), for gathering the articles in a the gathering zone, leads past a row of feed points, wherein, for carrying a stack of the articles, each of the stack supports (2) comprises a supporting surface (3) extending substantially transverse to the conveying path and a foot element (4) arranged in a bottom zone of the supporting surface (3), the foot elements (4) being designed and actively connected to the supporting surfaces (3) so as to be capable of being pressed towards the supporting surfaces (3) and to be capable of being distanced from the supporting surfaces (3), wherein stack support means (10) are disposed in the exposure zone (1), said stack support means (10) being capable of moving in synchronism and substantially in the same direction with the stack supports (2), said stack support means (10), at the entrance to the exposure zone (1), being positioned immediately underneath the stack supports (2) and further downstream, said stack support means (10) moving away from the stack supports (2), and wherein the control means is operable to control each of the foot elements such that:

the foot element is pressed against the supporting surface during conveyance through the gathering zone so as to align bottom edges of the gathered articles and to support the stack of gathered articles, the foot element is distanced from the supporting surface on entering the exposure zone so as to allow the gathered stack to slide downwards onto the stack support means, the foot element remains distanced from the supporting surface during conveyance through at least part of the exposure zone so as to allow further downward sliding of the stack guided by the stack support means moving away from the stack support, the foot element is pressed against the slid down stack so as to clamp the stack to the supporting surface, and the foot element remains Pressed against the slid down stack during conveyance through the processing zone.

2. The device according to claim 1, wherein the foot elements (4) are mounted on the supporting surfaces (3) in a swivelling manner.

3. The device according to claim 1, wherein a tension spring (21) is arranged between the foot element (4) and the supporting surface (3).

4. The device according to claim 1, wherein the stack supports are components of substantially V-shaped gathering pockets (2'), wherein the supporting surface (3) forms one of two pocket walls situated opposite one another and the foot element (4) closes off a space between the pocket walls towards the bottom.

5. The device according to claim 1, wherein the stack support means (10) comprise individual stack support bases (11), which are coupled to a circulating conveying organ (12).

6. The device according to claim 5, wherein the stack support bases (11) comprise supporting surfaces oriented vertically to the supporting surfaces (3).

7. The device according to claim 1, wherein the control means for driving the foot elements (4) comprise cam surfaces (23) co-operating with guide rollers (22) arranged on the foot elements (4).

8. The device according to claim 1, wherein the control means comprise active components for activating selected ones of the foot elements (4) of stack supports (2).

9. The device according to claim 1, wherein, in the processing zone, further control means and further stack support means (10') with stack support bases (11') moving in the conveying direction and against the stack supports (2) are provided for bringing the foot elements (4) of stack supports (2) conveyed past from the position pressed against the supporting surface (3) to the position spaced from the stack support (3) and further downstream back into the position pressed against the supporting surface (3), and wherein the foot elements (4) and the further stack support bases (11') are designed such that they are able to mesh with one another.

10. The device according to claim 1, wherein, downstream of the exposure zone (1), means for changing a spatial orientation of the stack supports (3) are provided.

11. The device according to claim 10, wherein the direction of the conveying path (F) of the stack supports (2) is changed downstream of the exposure zone (1).

12. The device according to claim 10, wherein, downstream of the exposure zone (1), means for swivelling the stack supports (2) relative to the conveying path (F) are provided.

13. The device according to claim 10, wherein, in the processing zone, means for laying a covering sheet (43) onto exposed edge zones (13) is provided.

14. The device according to claim 1, wherein, in a further processing zone, a further conveying means (40) with grippers (41) is arranged such that the grippers take hold of exposed edge zones (13) and thereupon are capable of being closed, and wherein for releasing the stacks (6), a further control means is provided for bringing the foot elements (4) after the stacks have been taken hold of by the grippers (41) from the position pressed against the supporting surface (3) into the position at a distance from the supporting surface (3).

15. The device according to claim 1, wherein, in the processing zone, a further conveying means (40) with pockets (42) is arranged such that the exposed edge zones (13) are capable of being inserted into the pockets (42), and wherein, for release of the stacks (6), a further control means is provided for bringing the foot elements (4) following insertion of exposed edge zones (13) into the pockets (42) from the position pressed against the supporting surface (3) into the position spaced from the supporting surface (3).

* * * * *